US005121928A

United States Patent [19]

Salerno-Sonneberg

[11] Patent Number: 5,121,928

[45] Date of Patent: Jun. 16, 1992

[54] METHOD OF PLAYING A QUESTION AND ANSWER MOVIE BOARD GAME

[76] Inventor: Nadja Salerno-Sonneberg, 771 West End Ave., New York, N.Y. 10425

[21] Appl. No.: 693,347

[22] Filed: Apr. 30, 1991

[51] Int. Cl.[5] ..... A63F 3/00; A63F 9/18

[52] U.S. Cl. ..... 273/243; 273/431

[58] Field of Search ..... 273/243, 248-254

[56] References Cited

U.S. PATENT DOCUMENTS

| | | | |
|---|---|---|---|
| 4,121,823 | 10/1978 | McBride | 273/249 |
| 4,315,627 | 2/1982 | Schlegel et al. | 273/249 |
| 4,372,554 | 2/1983 | Orenstein | 273/237 |
| 4,583,737 | 4/1986 | Falcone et al. | 273/292 |
| 4,714,255 | 12/1987 | Henry et al. | 273/249 |
| 4,787,639 | 11/1988 | Ross | 273/249 |
| 4,900,031 | 2/1990 | Wohl | 273/243 |
| 4,932,667 | 6/1990 | Gorski | 273/249 |

OTHER PUBLICATIONS

Trivial Pursuit, Master Game-Rules of Play.

*Primary Examiner*—Benjamin Layno

*Attorney, Agent, or Firm*—Frishauf, Holtz, Goodman & Woodward

[57] ABSTRACT

A question and answer board game relating to the movies. The game includes a board having an endless path divided into a plurality of contiguous spaces, a starting space and spaces having indicia thereon corresponding to a respective movie category of Romance, Science Friction, Horror, Comedy, and Adventure. The game further includes differently identified playing pieces, each assigned to a different player and plurality of question cards, divided into different stacks. Each stack of cards corresponds to one movie category and each card has at least a quote from a movie and the title of the movie printed thereon. Using a pair of dice the players advance their playing pieces around the board from space to space, wherein a player must name the title of the movie printed on a card which corresponds to the movie category of the space to which the player is advanced, upon being read a quote from the movie. Each player receives a marker corresponding to a movie category, upon correctly identifying a predetermined number of movie titles in the respective movie category, wherein play is terminated when a player receives a marker for each of the movie categories.

4 Claims, 2 Drawing Sheets

METHOD OF PLAYING A QUESTION AND ANSWER MOVIE BOARD GAME

BACKGROUND OF THE INVENTION

The present invention relates generally to amusement devices, and more particularly, is directed to a novel board game dealing with movie titles and the like.

Board games in which a player must travel around a peripheral path on a board, are well known. Such board games are further varied with respect to their objects, and with respect to the manner of play.

Further, various board games are known in which a player must identify individuals to continue play, or to win the game. For example, U.S. Pat. No. 4,315,627 to Schlegel et al. discloses a board game in which the players are given clues as to the identity of a famous person during travel around the board. This game is similar to the game of twenty questions, that is, where the player may ask a maximum of twenty questions in order to determine the name of the famous person. A player wins the game when he advances to a position within the last ten spaces, and correctly identifies the famous person on the card then being considered.

U.S. Pat. No. 4,714,255 to Henry et al. discloses an educational board game. In this game, there are two peripheral paths that intersect each other at various points, one path being a "bad guys track" and the other path being a "good guys track". The two paths, however, are not endless. In order to move along the paths, the players throw a die and must answer questions along the path. The player who reaches the finish first, and answers the question correctly at the finish, is the winner. However, only a maximum of two players (or teams) can play at any given time.

U.S. Pat. No. 4,900,031 to Wohl discloses a board game in which the players travel around a peripheral path on the board. There are two stacks of cards, one containing first name initials and the other containing last name initials. A player must name a famous person having the first and last name initials. When the player does so, he is awarded a point. Play continues for a specified period of time, and the winner is determined by the total number of points. In this game, however, there is no identification of a particular individual.

See also U.S. Pat. No. 4,787,639 to Ross for a less relevant board game.

U.S. Pat. No. 4,372,554 to Orenstein discloses an electronic question and answer game which uses a microprocessor and a plurality of modules which can change the nature of the game.

In addition to the above patents, there is also a game commonly sold under the trademark "TRIVIAL PURSUIT". In this game, the players travel around a board by rolling a die. Each space is associated with a particular category. For example, in the Silver Screen Edition, the categories are Settings, Titles, Off Screen, On Screen, Production, and Portrayals. Upon landing on a space, the player is asked a question. If answered correctly, the player rolls again. There is only one headquarters space for each category. When a player lands on a headquarters space, and answers the question correctly, he receives a wedge, thereby fulfilling his obligation for that category. When all six wedges for all categories are obtained, the player then must move to the center of the board, and answer the question correctly to win.

OBJECTS AND SUMMARY OF THE INVENTION

Accordingly, it is an object of the present invention to provide a board game that tests a player's knowledge of entertainment performance, such as movies It is still another object of the present invention to provide a board game that provides competition between players based on the players' knowledge of the movies.

In accordance with an aspect of the present invention, a board game includes a board having an endless path thereon, the endless path being divided into a plurality of contiguous spaces, at least one of the spaces being a starting space and the spaces other than the starting space having indicia thereon corresponding to a respective movie category; a plurality of differently identified playing pieces, each assigned to a different player; a plurality of stacks of cards, each card having at least a quote from a movie and the title of the movie printed thereon, each stack of cards corresponding to one movie category; random number generating means for determining advancement of the playing pieces around the board from space to space, wherein a player must identify the title of the movie printed on a card which corresponds to the movie category of the space to which the player is advanced, upon being read a quote from the movie; and a plurality of markers, each corresponding to a respective movie category, and each player receiving a marker for each movie category, upon correctly identifying a predetermined number of movie titles in the movie category, wherein play is terminated when a player receives a marker for each of the movie categories.

In accordance with another aspect of the present invention, a method of playing a board game of the type including a board having an endless path thereon, the endless path being divided into a plurality of contiguous spaces, at least one of the spaces being a starting space and the spaces other than the starting space having indicia thereon corresponding to a respective movie category; a plurality of differently identified playing pieces, each assigned to a different player; a plurality of stacks of cards, each card having at least a quote from a movie and the title of the movie printed thereon, each stack of cards corresponding to one movie category; random number generating means for determining advancement of the playing pieces around the board from space to space; and a plurality of markers, each corresponding to a respective movie category, the method including the steps of advancing a playing piece along a predetermined number of the spaces, as determined by the random number generating means; identifying the movie category corresponding to the space upon which the playing piece lands; picking a card from the stack corresponding to the movie category; reciting the quote from the card; requiring the player to identify the title of the movie containing the quote; permitting further advancement by the player, as determined by said random number generating means, upon correctly identifying the movie title; repeating the step of advancement for another player if the first-mentioned player incorrectly identifies the move title; supplying a marker corresponding to a movie category, to each player that correctly identifies a predetermined number of movie titles in the movie category; and terminating play when a player receives a marker for each of the movie categories.

The above and other objects, features and advantages of the present invention will become readily apparent from the following detailed description, which is to be read in connection with the accompanying drawings.

DETAILED DESCRIPTION OF A PREFERRED EMBODIMENT

Figure 1:
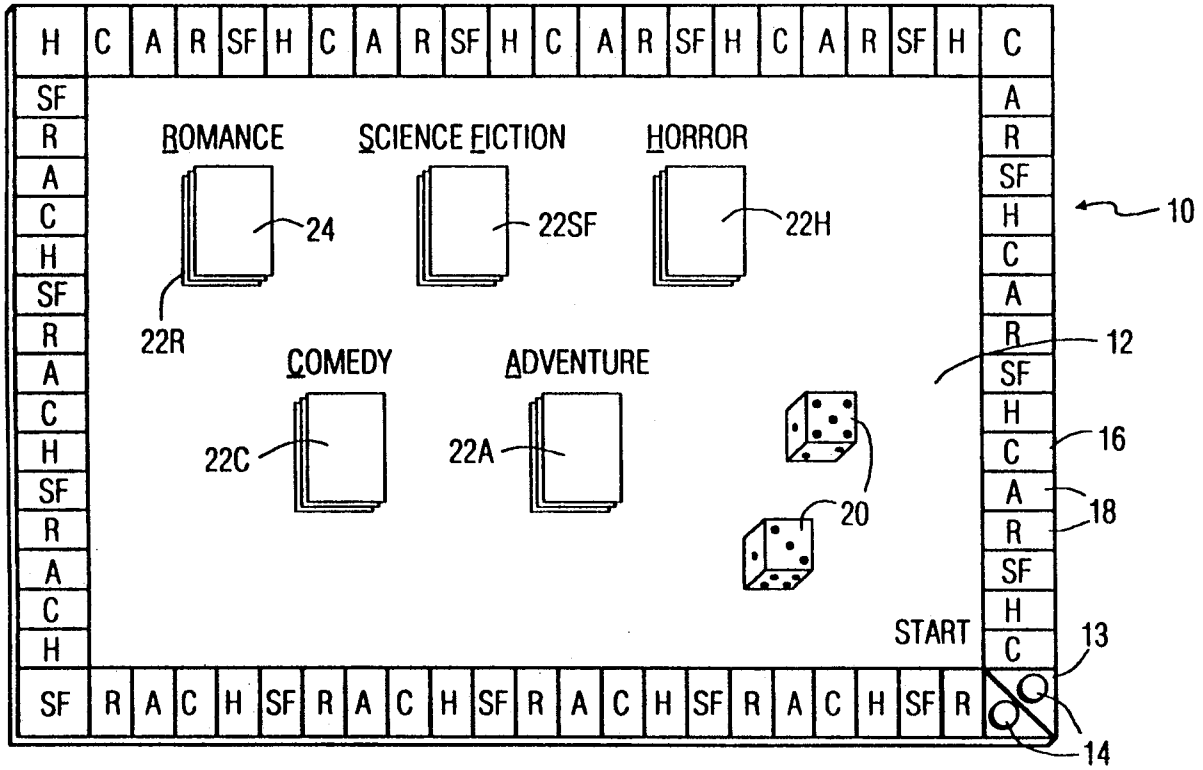
FIG. 1 is a perspective view of a board game according to the present invention.

Referring to the drawings in detail, a board game 10 according to an embodiment of the present invention, includes a rectangular board 12 having an endless peripheral playing path 14 about which playing pieces 16 move. Playing pieces 16 each have a different identity by any suitable means, such as shape, color or the like.

Playing path 14 is divided into a plurality of marked spaces 18, designated by a particular movie category. For example, there may be five movie categories of Romance, Science Fiction, Horror, Comedy and Adventure, designated by R, SF, H, C and A on the respective spaces 18. The present invention is not limited, however, to this number or these specific movie categories, and other categories, such as Drama or the like may be used. In addition, playing path 14 includes a start space 19 at which playing pieces 16 are positioned at the start of the game.

Random number generating means are provided for advancing playing pieces 16 along path 14. For example, random number generating means can include a pair of dice 20, as shown in FIG. 1.

Board game 10 further includes a plurality of stacks 22R, 22SF, 22H, 22C and 22A of cards 24, each stack containing cards 24 directed to one of the five categories of Romance, Science Fiction, Horror, Comedy and Adventure, respectively. Each card 24 contains a direct quote from a well-known movie, as well as the movie title, the name of the character in the movie who recited the quote, and the name of the actor who portrayed the character in the movie. The name of the character and the name of the actor fall under a Bonus category on the card. Preferably, there are between 100 and 200 cards 24 for each category.

Figure 2:
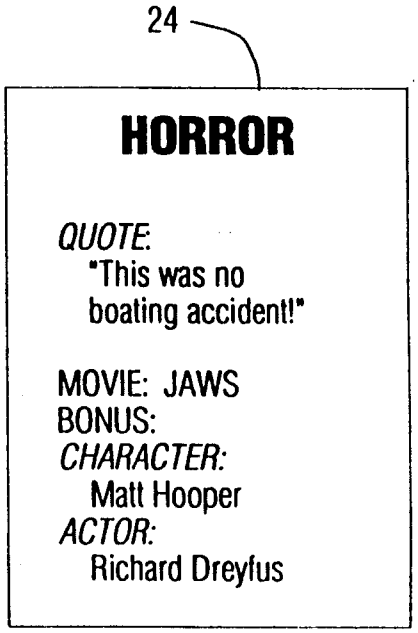
FIG. 2 is a top plan view of one of the playing cards of the board game of FIG. 1.
Figure 3:
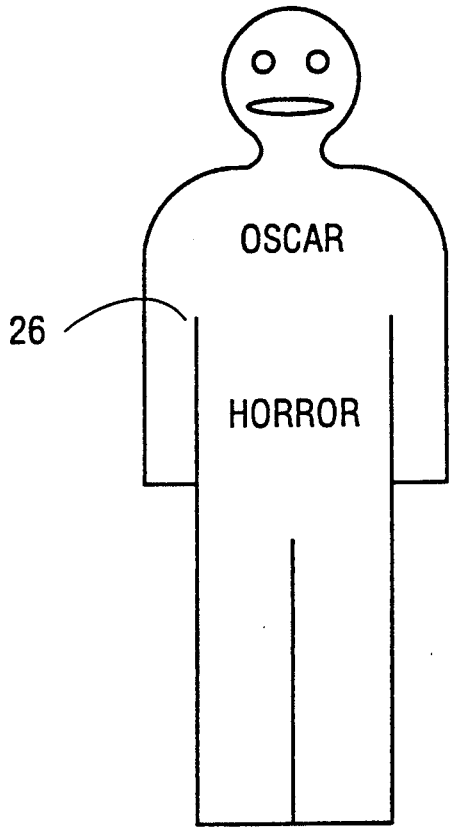
FIG. 3 is an elevational view of one marker of the board game of FIG. 1.

An example of a card 24 which would fall under the Horror category is shown in FIG. 2, and includes the quote "This was no boating accident!" The quote was from the movie JAWS, and was stated by the character Matt Hooper, played by Richard Dreyfuss.

Examples of other quotes in the various categories are as follows:

| | |
|---|---|
| | ROMANCE |
| Quote | "Snap out of it!" |
| Movie | Moonstruck |
| Character | Loretta Castorini |
| Actor | Cher |
| Quote | "Oh Jerry, don't let's ask for the moon, we have the stars." |
| Movie | Now Voyager |
| Character | Charlotte Vale |
| Actor | Bette Davis |
| Quote | "What kind of pie?" |
| Movie | The Way We Were |
| Character | Hubble Gardner |

-continued

| | |
|---|---|
| Actor | Robert Redford |
| | SCIENCE FICTION |
| Quote | "Time to die." |
| Movie | Blade Runner |
| Character | Roy |
| Actor | Rutger Hauer |
| Quote | "With my last breath, I grapple with thee." |
| Movie | Star Trek II: The Wrath of Khan |
| Character | Khan |
| Actor | Ricardo Montalban |
| Quote | "Consider this a divorce." |
| Movie | Total Recall |
| Character | Douglas Quaid |
| Actor | Arnold Schwarzenegger |
| | HORROR |
| Quote | "I've given you the gift of everlasting life." |
| Movie | The Hunger |
| Character | Miriam Blaylock |
| Actor | Catherine Deneuvre |
| Quote | "Stay away from her you bitch." |
| Movie | Aliens |
| Character | Ripley |
| Actor | Sigorney Weaver |
| Quote | "FBI, you're safe." |
| Movie | Silence of the Lambs |
| Character | Clarice Starling |
| Actor | Jodie Foster |
| | COMEDY |
| Quote | "Do these come in any other colors?" |
| Movie | Private Benjamin |
| Character | Judy Benjamin |
| Actor | Goldie Hawn |
| Quote | "Vat a nice guy." |
| Movie | Blazing saddles |
| Character | Lili Van Shtumf |
| Actor | Madeline Kahn |
| Quote | "I anxiously await your next syllable." |
| Movie | Arthur |
| Character | Hobson |
| Actor | Sir John Geilgud |
| | ADVENTURE |
| Quote | "All's fair in love and business . . . Benjamin Franklin." |
| Movie | Dick Tracy |
| Character | Big Boy Caprice |
| Actor | Al Paccino |
| Quote | "Don't call me Junior." |
| Movie | Indiana Jones, The Last Crusade |
| Character | Indiana Jones |
| Actor | Harrison Ford |
| Quote | "I can't swim." |
| Movie | Butch Cassidy and the Sundance Kid |
| Character | Sundance |
| Actor | Robert Redford |

Each time that a player lands on a new space 18, one of the other players must read the quote to that player, who must then identify the title of the movie containing the quote. For example, if player A lands on a Horror space 18, player B reads the quote, and player A must identify the title of the movie containing the quote in order for player A to continue with his turn. If player A identifies the correct movie title, he continues play.

In this regard, the player has two options for continuing play. First, the player can roll the dice again. In such case, the player will land on another space 18, and be required to identify the title of the movie corresponding to another quote, possibly in another category. Alternatively, the player can obtain one bonus point by identifying both the name of the character who recited the quote in the movie and the name of the actor who played the character. If the player answers correctly, he continues play by rolling the dice. As long as a player answers correctly each time, it is still that player's turn.

After a player names five correct movie titles in a category, the player receives a marker 26 which may be shaped, for example, as an Oscar having indicia thereon corresponding to that category.

The object of the game is to obtain five Oscars 26, one for each category. In the event that two or more players obtain five Oscars 26 during the same respective turn, the winner of the game may be determined by the player with the most bonus points.

If a player lands on a category for which he has already received an Oscar 26, the player must still answer correctly to continue to play.

It will therefore be appreciated that the present invention provides a novel board game that provides competition between players based on the players'-knowledge of entertainment performance, such as movies.

Having described a specific preferred embodiment of the invention with reference to the accompanying drawings, it will be appreciated that the present invention is not limited to that specific embodiment, and that various changes and modifications can be effected therein by one of ordinary skill in the art, without departing from the scope or spirit of the invention as defined in the appended claims.

What is claimed is:

1. A method of playing a board game based on entertainment performances including an actor, the board game including a board having an endless path thereon, said endless path being divided into a plurality of contiguous spaces, at least one of said spaces being a starting space and said spaces other than said starting space having indicia thereon corresponding to respective category of entertainment performances; a plurality of differently identified playing pieces, each assigned to a different player; a plurality of stacks of cards, each card having a quote from a performance and the title of the performance, the name of the character who recited the quote in the performance, and the name of the actor who portrayed the character in the performance printed thereon, each stack of cards corresponding to one said performance category; random number generating means for determining advancement of said playing pieces around the board from space to space; and a plurality of markers, each corresponding to a respective performance category, said method comprising the steps of:

(a) advancing a playing piece along a predetermined number of said spaces, as determined by said random number generating means;

(b) identifying the performance category corresponding to the space upon which said playing piece lands;

(c) picking a card from the stack corresponding to said performance category;

(d) reciting the quote from said card;

(e) requiring said player to identify the title of the performance containing said quote;

(f) permitting said player two options upon correctly identifying said performance title, wherein said first option is to identify at least one of the name of the character who recited the quote in the performance and the name of the actor who portrayed the character in the performance for a bonus point, and said second option is to continue playing piece advancement by repeating steps (a)-(f);

(g) receiving said bonus point and repeating steps (a)-(f) by said player, as determined by said random number generating means, upon correctly identifying said performance title and upon correctly identifying at least one of the name of the character who recited the quote in the performance and the name of the actor who portrayed the character in the performance;

(h) repeating steps (a)-(g) for another player if the first-mentioned player incorrectly identifies said performance title or incorrectly identifies at least one of the name of the character who recited the quote in the performance and the name of the actor who portrayed the character in the performance;

(i) supplying a marker corresponding to a performance category, to each player that correctly identifies a predetermined number of performance titles in said performance category; and (j) terminating play when at least one player receives a marker for each of the performance categories, wherein in the event that two or more players have received a marker for each of the performance categories, a winner is the player having said marker for each of the performance categories and having accumulated the most bonus points.

2. A method according to claim 1, wherein said entertainment performances are movies.

3. A method according to claim 2, wherein said movie categories include at least five of the following: Romance, Science Fiction, Horror, Comedy, Adventure and Drama.

4. A method according to claim 2, wherein there are five movie categories.

* * * * *